US011285068B2

(12) United States Patent
Powell

(10) Patent No.: US 11,285,068 B2
(45) Date of Patent: Mar. 29, 2022

(54) FOOT AND ANKLE STRENGTHENING DEVICE

(71) Applicant: Floyd Powell, Houston, TX (US)

(72) Inventor: Floyd Powell, Houston, TX (US)

( * ) Notice: Subject to any disclaimer, the term of this patent is extended or adjusted under 35 U.S.C. 154(b) by 335 days.

(21) Appl. No.: 16/672,301

(22) Filed: Nov. 1, 2019

(65) Prior Publication Data

US 2020/0138662 A1 May 7, 2020

Related U.S. Application Data

(60) Provisional application No. 62/754,452, filed on Nov. 1, 2018.

(51) Int. Cl.
*A61H 1/02* (2006.01)
*A61H 15/00* (2006.01)

(52) U.S. Cl.
CPC ..... *A61H 1/0266* (2013.01); *A61H 15/00* (2013.01); *A61H 2015/0014* (2013.01); *A61H 2201/0173* (2013.01); *A61H 2201/164* (2013.01); *A61H 2201/1695* (2013.01); *A61H 2203/0406* (2013.01)

(58) Field of Classification Search
CPC .... A61H 1/0266; A61H 15/00; A61H 15/092; A61H 15/0078; A61H 15/02; A61H 15/0092; A61H 2015/0014; A61H 2015/0021; A61H 2015/0028; A61H 2015/0035; A61H 2201/1695; A61H 2201/0173; A61H 2201/164; A61H 2201/1676; A61H 2201/1671; A61H 7/002; A61H 2203/0406
USPC ..... 601/18, 19, 28, 29; 482/79, 146, 80, 482/121, 142
See application file for complete search history.

(56) References Cited

U.S. PATENT DOCUMENTS

| | | | | |
|---|---|---|---|---|
| 2,072,959 A | | 3/1937 | Mulvaney et al. | |
| D127,686 S | * | 6/1941 | Milton | D24/212 |
| 2,250,493 A | | 7/1941 | Milne | |
| 2,767,707 A | | 10/1956 | Toivonen | |
| 3,361,427 A | * | 1/1968 | Paves | A63B 22/16 482/146 |
| D243,557 S | | 3/1977 | Kientz | |

(Continued)

FOREIGN PATENT DOCUMENTS

WO WO2002068068 A1 9/2002

*Primary Examiner* — Samchuan C Yao
*Assistant Examiner* — Nathan M Le

(57) ABSTRACT

A foot and ankle strengthening device is an apparatus used to provide stimulus to muscles typically weakened in people who suffer from various foot and ankle problems, particularly plantar fasciitis. A pair of angled surfaces is used to reinforce healthy foot arches. The apparatus comprises a first foot-bracing platform, a second foot-bracing platform, a textured roller, and an elongated balance block. The first foot-bracing platform is a surface against which a user may place a foot for support and appropriate positioning. Similarly, the second foot-bracing platform provides a surface for the user's opposite foot. The textured roller is a generally cylindrical device that enables the user to apply targeted pressure to specific pieces of the user's foot or ankle. The elongated balance block is a generally rectangular prism-shaped protrusion that, in the preferred usage of the apparatus, provides the contact point with the ground.

19 Claims, 6 Drawing Sheets

(56) References Cited

U.S. PATENT DOCUMENTS

| | | | | | |
|---|---|---|---|---|---|
| 4,142,519 | A | | 3/1979 | Ferguson | |
| D271,420 | S | | 11/1983 | Sierra | |
| 4,660,548 | A | * | 4/1987 | Bucher | A61H 23/0254 601/61 |
| 4,832,006 | A | * | 5/1989 | Kirsch | A61H 1/008 601/122 |
| 5,643,164 | A | * | 7/1997 | Teff | A63B 22/16 482/146 |
| 5,765,921 | A | * | 6/1998 | Chuang | A47C 16/025 297/423.41 |
| 5,891,002 | A | * | 4/1999 | Maki | A63B 22/16 482/79 |
| 8,360,940 | B2 | * | 1/2013 | Kole | A63B 23/10 482/121 |
| 2005/0203445 | A1 | * | 9/2005 | Tsai | A61H 15/02 601/15 |
| 2007/0129654 | A1 | * | 6/2007 | Anderson | A61H 15/00 601/119 |
| 2011/0269605 | A1 | * | 11/2011 | Kim | A63B 23/0458 482/121 |
| 2014/0142479 | A1 | * | 5/2014 | Kaur | A45C 15/00 601/118 |
| 2015/0238348 | A1 | * | 8/2015 | Kamat | A61H 15/00 601/19 |
| 2016/0067550 | A1 | * | 3/2016 | Breach | A43B 5/00 36/103 |
| 2020/0038282 | A1 | * | 2/2020 | Bui | A61H 7/001 |

* cited by examiner

FOOT AND ANKLE STRENGTHENING DEVICE

The current application claims a priority to the U.S. Provisional Patent application Ser. No. 62/754,452 filed on Nov. 1, 2018.

FIELD OF THE INVENTION

The present invention generally relates to medical devices and exercise devices. More specifically, the present invention relates to a device which is designed to activate and strengthen lower leg muscles.

BACKGROUND OF THE INVENTION

Weakness of the medial arch of the foot due to inhibited and weak lower leg muscles causes a breakdown of the kinetic chain, which can cause internal rotation and flattening of the feet and create stress on the feet, knees, hip and back. Many health professionals, including podiatrists, chiropractors, and physical therapists, utilize orthotics and custom shoe inserts to artificially raise the arch of the foot, reducing the stress in the foot, knee, hip and back. These solutions may cause a short-term correction of the issues; however, by treating the symptoms instead of the root cause, such solutions over a long time period also often cause a breakdown and weakness of the muscles which are tasked with supporting the arch naturally.

Plantar fasciitis is one of the most common resultant issues found in clinical sports medicine practice. Most of the time, this condition results from excessive stress of the plantar fascia due to a breakdown of these lower leg muscles. When these muscles are activated, an almost immediate relief from the symptoms from plantar fasciitis can be seen. Correction by strengthening of the medial arch naturally reduces stress in the lower body, which consequently improves the strength of the posterior chain and thus reduces stress in the overall body.

An objective of the present invention is to provide an apparatus for stabilization and relief of symptoms caused by weak lower leg muscles. The present invention, preferably referred to as the arch rocker, is a wobble board designed to activate and strengthen specific leg muscles by stimulating the leg muscles' specific action, thereby strengthening and stabilizing medial arch of the foot. The arch rocker can also include a built-in foot roller which can be frozen to reduce inflammation and pain. The activation of these muscles over time can create a stronger and more functional arch, thus reducing dropped arch and associated conditions such as pes planus, plantar fasciitis, posterior tibial tendonitis, anterior tibial tendonitis (also known as shin splints), Achilles tendonitis, calf sprains/strains, knee, and/or hip and lower back pain which can be caused by these dysfunctional and weak muscles altering biomechanical actions in the kinetic chain. The arch rocker can activate and strengthen various leg muscles including, but not limited to, the posterior tibialis, the anterior tibialis, the peroneus longus, the flexor hallucis longus, and/or the gastrocnemius, soleus, and Achilles tendons.

DETAILED DESCRIPTION OF THE INVENTION

All illustrations of the drawings are for the purpose of describing selected versions of the present invention and are not intended to limit the scope of the present invention.

Figure 1:
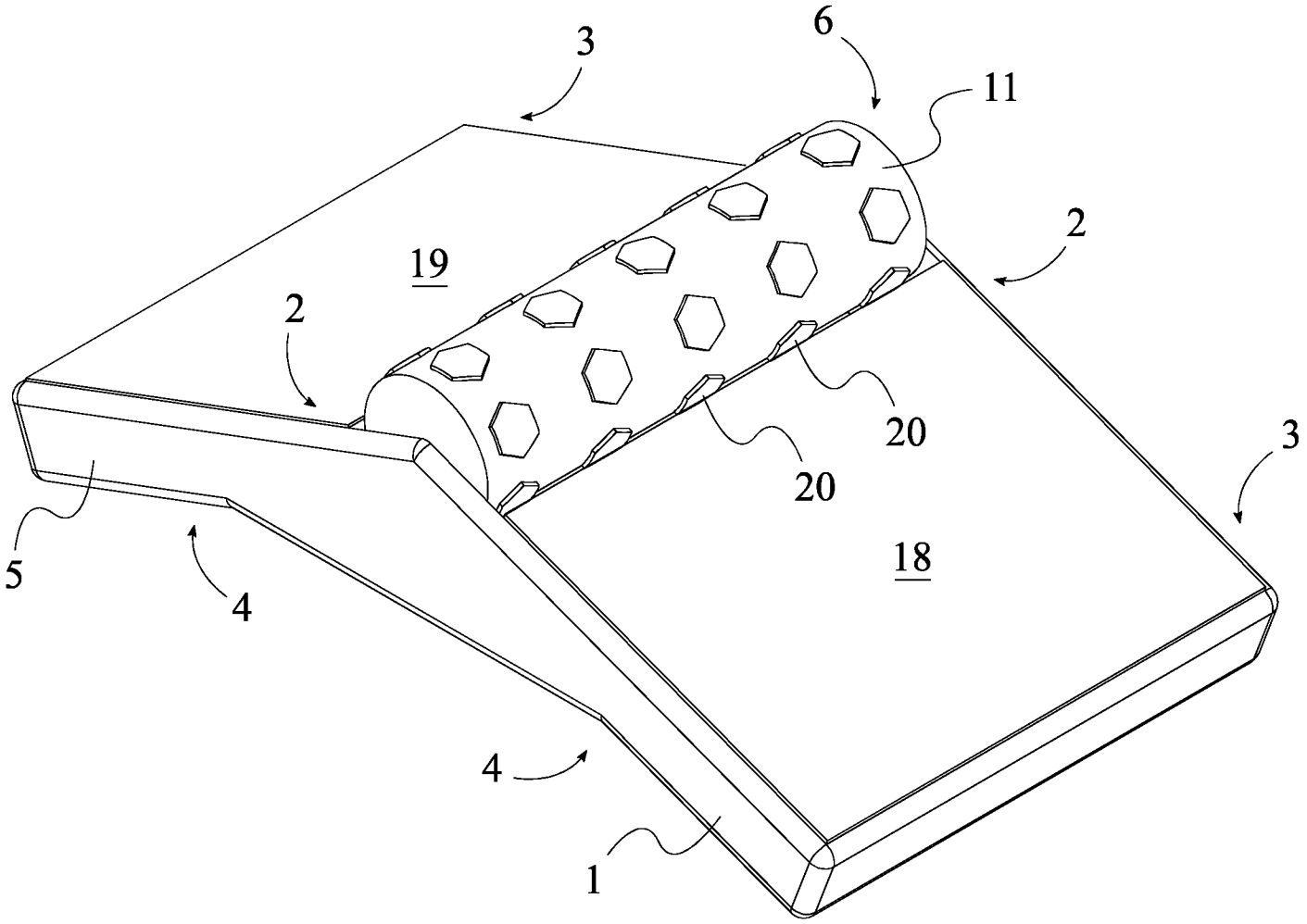
FIG. 1 is a top-right perspective view of the present invention.

The present invention is a foot and ankle strengthening device that is used to provide stimulus to muscles typically weakened in people who suffer from various foot and ankle problems, particularly plantar fasciitis. The present invention utilizes a pair of angled surfaces to reinforce healthy foot arches, and a block as the primary support. The present invention comprises a first foot-bracing platform 1, a second foot-bracing platform 5, a textured roller 6, and an elongated balance block 12, as seen in FIG. 1. The first foot-bracing platform 1 is a surface against which a user may place a foot for support and appropriate positioning. Similarly, the second foot-bracing platform 5 provides, in the preferred usage of the present invention, a surface for the user's opposite foot. The textured roller 6 is a generally cylindrical device that enables the user to apply targeted pressure to specific pieces of the user's foot or ankle. The elongated balance block 12 is a generally rectangular prism-shaped protrusion that, in the preferred usage of the present invention, provides the contact point with the ground.

These components together enable the present invention to provide an appropriate muscular-skeletal stimulus for the user's ankles and feet. The first foot-bracing platform 1 and the second foot-bracing platform 5 each comprise a proximal edge 2 and a distal edge 3. The proximal edge 2 is the edge closest to the space between the first foot-bracing platform 1 and the second foot-bracing platform 5. The distal edge 3 is the edge furthest from the space between the first foot-bracing platform 1 and the second foot-bracing platform 5. The proximal edge 2 of the first foot-bracing platform 1 and the proximal edge 2 of the second foot-bracing platform 5 are positioned adjacent to each other. The first foot-bracing platform 1 and the second foot-bracing platform 5 are therefore positioned adjacent to each other, thus enabling the user to stand with feet positioned near each other.

Figure 2:
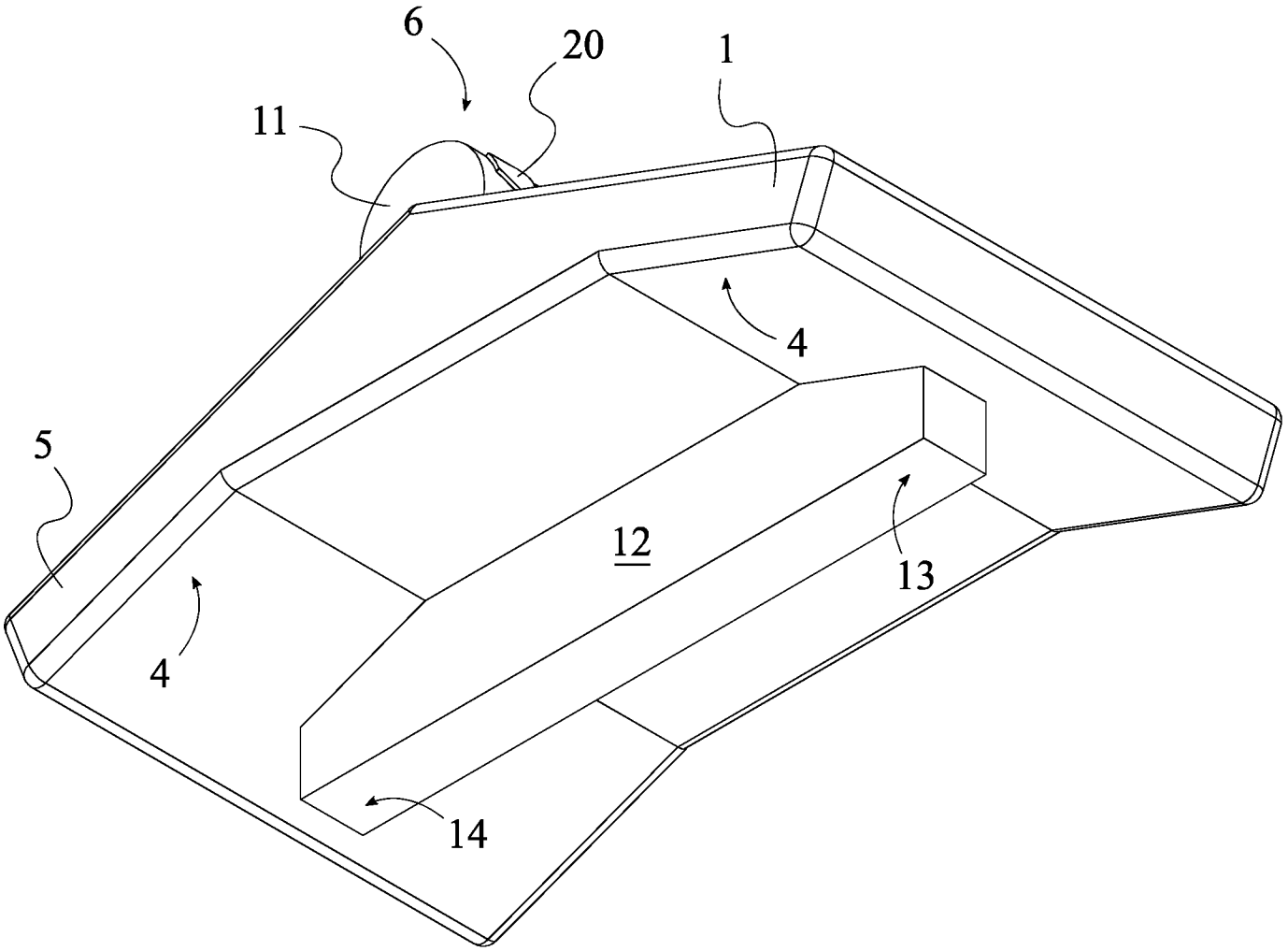
FIG. 2 is a bottom-right perspective view of the present invention.

The textured roller 6 is rotatably mounted between the proximal edge 2 of the first foot-bracing platform 1 and the proximal edge 2 of the second foot-bracing platform 5. In this way, the textured roller 6 is positioned to be equally accessible for each of the user's feet. Further, this positioning provides the textured roller 6 support across the present invention, thus allowing the user to utilize the textured roller 6 for ankles and foot muscles while standing adjacent to the first foot-bracing platform 1 and the second foot-bracing platform 5. The elongated balance block 12 is mounted between the distal edge 3 of the first foot-bracing platform 1 and the distal edge 3 of the second foot-bracing platform 5, as seen in FIG. 2. Thus, the elongated balance block 12 is positioned to provide support across the present invention from the ground or other preferably flat surface upon which the present invention rests. Furthermore, the elongated balance block 12 is centrally positioned along the distal edge 3 of the first foot-bracing platform 1 and the distal edge 3 of the second foot-bracing platform 5. In this way, the elongated balance block 12 is positioned to provide unstable support. This is desirable, as instability requires the user to activate relevant core muscles to maintain balance.

Figure 3:
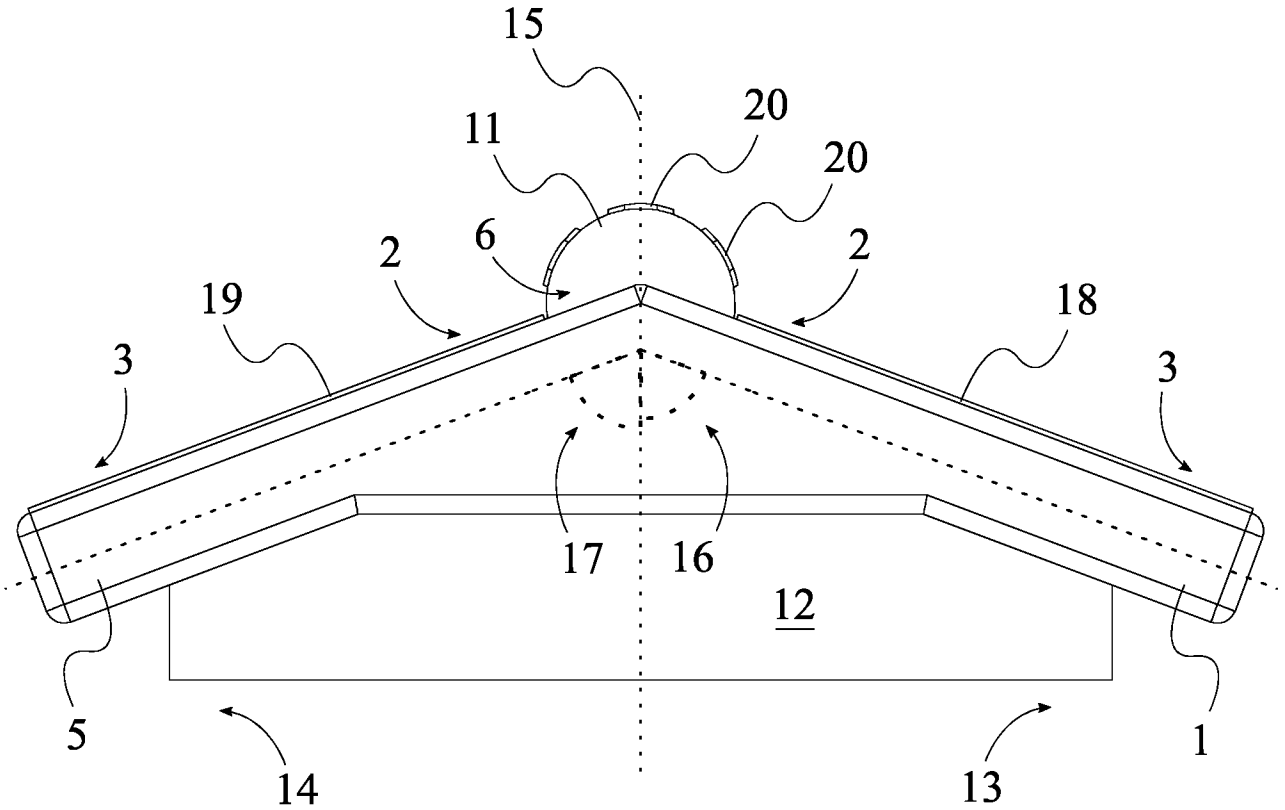
FIG. 3 is a front view of the present invention.

A sagittal plane 15 is positioned in between the first foot-bracing platform 1 and the second foot-bracing platform 5. The sagittal plane 15 is a geometric plane which divides the present invention roughly in half. The first foot-bracing platform 1 is oriented at a first interior acute angle 16 with the sagittal plane 15, as seen in FIG. 3. This arrangement ensures that the first foot-bracing platform 1 is at an angle appropriate for supporting the user's foot. Similarly, the second foot-bracing platform 5 is oriented at a second interior acute angle 17 with the sagittal plane 15. In this way, the second foot-bracing platform 5 is at an angle appropriate for supporting the user's foot opposite the first foot-bracing platform 1. The elongated balance block 12 is positioned normal to the sagittal plane 15. Thus, the elongated balance block 12 is arranged to provide instable support for the present invention.

Figure 4:
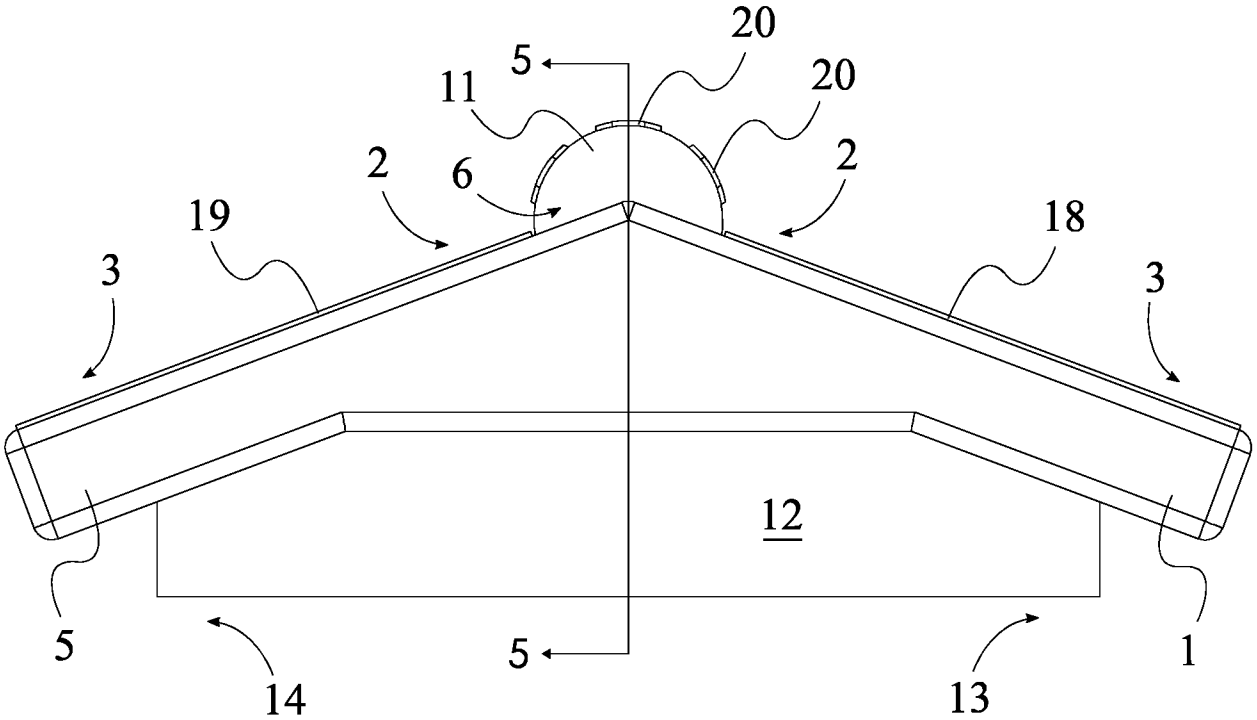
FIG. 4 is a front view of the present invention.

The user experience may improve through the inclusion of gripping features and mechanisms for the user's foot. To this end, the present invention further comprises a first textured layer 18, as seen in FIG. 4. The first textured layer 18 is a high-friction surface that may further include a variety of features, including, but not limited to, bumps, ridges, crevices, and more. The first textured layer 18 is connected across the first foot-bracing platform 1, opposite the elongated balance block 12. This arrangement provides a foot of the user with ample traction for remaining upon the first foot-bracing platform 1.

Furthermore, the user may also benefit from the inclusion of assistive features for the other foot of the user. To this end, the present invention further comprises a second textured layer 19, as seen in FIG. 4. The second textured layer 19 is a high-friction surface that may further include a variety of features, including, but not limited to, bumps, ridges, crevices, and more. The second textured layer 19 is connected across the second foot-bracing platform 5, opposite the elongated balance block 12. This arrangement provides a foot of the user with ample traction for remaining upon the second foot-bracing platform 5.

Figure 6:
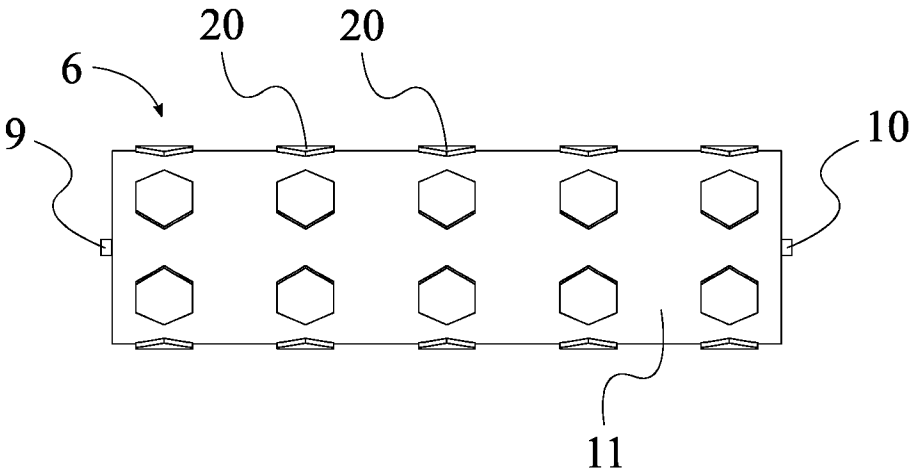
FIG. 6 is a front view of a textured roller of the present invention.

The textured roller 6 further benefits from employment of features that can improve the user's ability to interact with soft tissue in the user's feet and ankles. To this end, the present invention further comprises a plurality of grip-enhancing features 20, as seen in FIG. 6. The plurality of grip-enhancing features 20 is a set of shaped devices, including, but not limited to, bumps, ridges, and other such features that provide unique stimulus to muscular groups. The plurality of grip-enhancing features 20 is laterally connected around the textured roller 6. In this way, the user may control specific stimulus received by areas of the user's foot or ankle area while using the textured roller 6.

The plurality of grip-enhancing features 20 is particularly effective in specific configurations. To this end, in an exemplary embodiment, each of the plurality of grip-enhancing features 20 is configured into a hexagonal prism, as seen in FIG. 6. This arrangement provides edges and crevices that are advantageous to providing useful acute pressure to specific foot and ankle areas.

Figure 5:
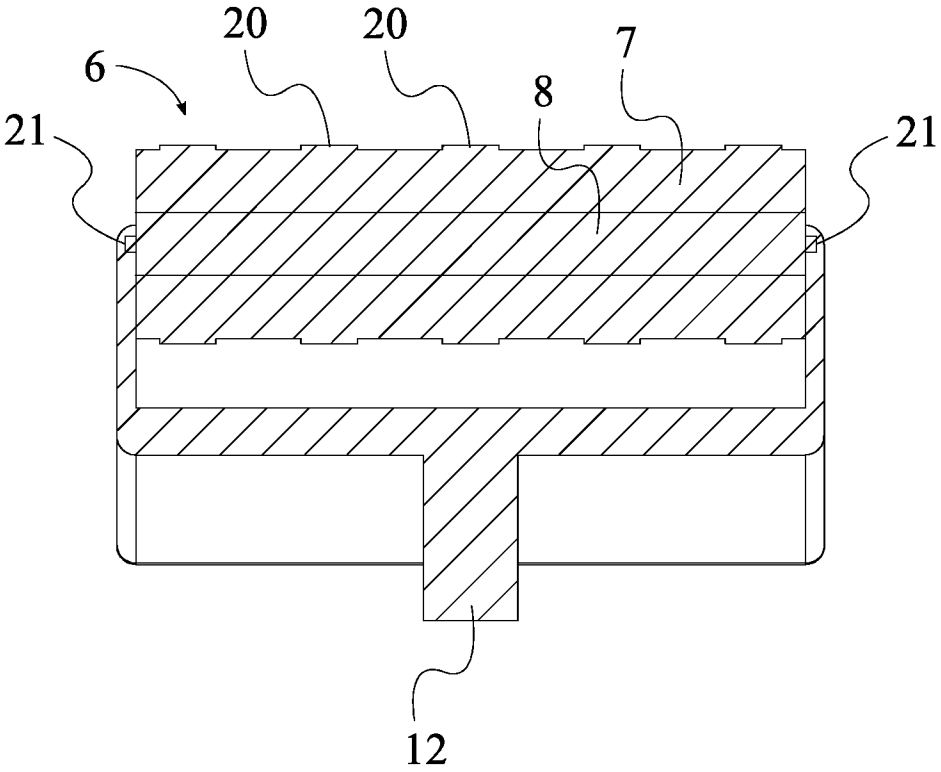
FIG. 5 is a cross-sectional view of the present invention about line 5-5 in FIG. 4.

The textured roller 6, which can be utilized to apply acute or broad pressure to specific regions of the foot or ankle, is made more effective through the employment of components that enable thermal engagement of muscular groups, thus allowing for improved blood flow in areas of interest. To this end, the textured roller 6 comprises a thermally-conductive housing 7 and a thermally-resistive core 8, as seen in FIG. 5. The thermally-conductive housing 7 is a generally cylindrical component that is made of any of a variety of thermally-conductive materials, thus enabling rapid transition between low and high temperatures. The thermally-resistive core 8 is a preferably cylindrical device made of thermally-resistive materials capable of retaining temperature. The thermally-resistive core 8 is mounted within the thermally-conductive housing 7. This arrangement enables proximity between the thermally-conductive housing 7 and the thermally-resistive core 8. The thermally-resistive core 8 is in thermal communication with the thermally-conductive housing 7. This arrangement enables the thermally-resistive core 8 to transfer heat to the thermally-conductive housing 7. The connection between the thermally-resistive core 8 and the thermally-conductive housing 7 allows for the transfer of both high temperatures as well as low temperatures. In this way, the textured roller 6 can be used to apply hot or cold temperatures to target areas depending upon the environment in which the thermally-resistive core 8 is placed. Placing and leaving the thermally-resistive core 8 into a refrigerator or freezer allows the thermally-resistive core 8 to retain and transmit low temperatures, while storing the thermally-resistive core 8 in an oven or other high temperature space allows the thermally-resistive core 8 to transmit hot temperatures to the thermally-conductive housing 7.

The elongated balance block 12 must be adequately shaped to provide the structural support required to stimulate the user's foot and ankle muscles appropriately. To achieve this, the elongated balance block 12 comprises a first block end 13 and a second block end 14, as seen in FIG. 3. The first block end 13 is the section of the elongated balance block 12 that receives pressure when the user shifts balance towards the first foot-bracing platform 1. Conversely, the second block end 14 is the section of the elongated balance block 12 that receives pressure when the user shifts balance towards the second foot-bracing platform 5. The first block end 13 is positioned offset from the distal edge 3 of the first foot-bracing platform 1. This arrangement allows the user to activate muscles required for balancing along the first block end 13. Similarly, the second block end 14 is positioned offset from the distal edge 3 of the second foot-bracing platform 5. This arrangement allows the user to activate muscles required for balancing along the second block end 14. The first block end 13 and the second block end 14 may be shaped to provide a more advantageous muscular stimulus. For example, the first block end 13 and the second block end 14 may be rounded, chamfered, ridged, bumped, or shaped in a variety of other ways.

The textured roller 6 must be rotatably connected between the first foot-bracing platform 1 and the second foot-bracing platform 5 in order to ensure that the user may access the textured roller 6 to provide acute soft tissue activation. To achieve appropriate connection, the present invention further comprises a roller mount 21, as seen in FIG. 5. The roller mount 21 is at least one fixture capable of enabling a rotatable connection to the rest of the relatively stationary present invention. The roller mount 21 may include various structures for positioning the textured roller 6, as well as bearings, bushings, or other components capable of enabling rotatable connection to the present invention. The roller mount 21 is integrated in between the proximal edge 2 of the first foot-bracing platform 1 and the proximal edge 2 of the second foot-bracing platform 5. This positioning is optimal for enabling desirable mounting of the textured roller 6. The textured roller 6 is rotatably attached into the roller mount 21. This arrangement enables the textured roller 6 to rotate in position relative to the first foot-bracing platform 1 and the second foot-bracing platform 5.

In an exemplary embodiment, the present invention is equipped to support and even partially suspend the textured roller 6 over the first foot-bracing platform 1 and the second foot-bracing platform 5. To achieve this, the textured roller 6 further comprises a first mounting protrusion 9, a second mounting protrusion 10, and a roller body 11, as seen in FIG. 1, as seen in FIG. 6. The first mounting protrusion 9 relates to a rigid structure that extends generally above the proximal edge 2 of the first foot-bracing platform 1 and the proximal edge 2 of the second foot-bracing platform 5. Similarly, the second mounting protrusion 10 relates to a rigid structure that extends generally above the proximal edge 2 of the first foot-bracing platform 1 and the proximal edge 2 of the second foot-bracing platform 5. The roller body 11 relates to the physical volume of space occupied by the textured roller 6. The first mounting protrusion 9 is terminally connected to the roller body 11. This allows the first mounting protrusion 9 to support the roller body 11 in position within or above the present invention. Similarly, the second mounting protrusion 10 is terminally connected to the roller body 11. This allows the second mounting protrusion 10 to support the roller body 11 in position within or above the present invention. The first mounting protrusion 9 and the second mounting protrusion 10 are rotatably engaged to the roller mount 21. This arrangement ensures that the roller body 11 is capable of rotating relative to the roller mount 21.

The first interior acute angle 16 may be any angle that is acute between the sagittal plane 15 and a perpendicular plane; however, a particular range of angles is generally considered most effective at providing desired muscular activation. To this end, the first interior acute angle 16 is in a range between 70 arc degrees and 80 arc degrees, as seen in FIG. 3. This range ensures both effectiveness and comfort for the user during use. Similarly, the second interior acute angle 17 is in a range between 70 arc degrees and 80 arc degrees. Together, this arrangement of the first interior acute angle 16 and the second interior acute angle 17, particularly in the exemplary embodiment in which the first interior acute angle 16 and the second interior acute angle 17 are equivalent angles, facilitates muscular stimulation without overwhelming or overstressing joints and ligaments.

The first foot-bracing platform 1 and the second foot-bracing platform 5 may function at a variety of different sizes; however, the first foot-bracing platform 1 and the second foot-bracing platform 5 are optimally of specific dimension ranges. To this end, the first foot-bracing platform 1 and the second foot-bracing platform 5 each comprise a platform body 4, as seen in FIG. 1. The platform body 4 is the physical volume of space occupied by each of the first foot-bracing platform 1 and the second foot-bracing platform 5. The width of the platform body 4 is preferably in a range between 6 inches (15.24 centimeters) to 12 inches (30.48 centimeters). This arrangement ensures ample breadth for the user's foot. Similarly, the length of the platform body 4 is preferably in a range between 12 inches (30.48 centimeters) to 18 inches (45.72 centimeters). In this way, the present invention has ample lateral space for feet of various sizes.

Although the invention has been explained in relation to its preferred embodiment, it is to be understood that many other possible modifications and variations can be made without departing from the spirit and scope of the invention as hereinafter claimed.

What is claimed is:

1. A foot and ankle strengthening device comprises:
- a first foot-bracing platform;
- a second foot-bracing platform;
- a textured roller;
- an elongated balance block;
- a first textured layer;
- the first foot-bracing platform and the second foot-bracing platform each comprise a proximal edge and a distal edge;
- the proximal edge of the first foot-bracing platform and the proximal edge of the second foot-bracing platform being positioned adjacent to each other;
- the textured roller being rotatably mounted between the proximal edge of the first foot-bracing platform and the proximal edge of the second foot-bracing platform;
- the elongated balance block being mounted between the distal edge of the first foot-bracing platform and the distal edge of the second foot-bracing platform;
- the elongated balance block being centrally positioned along the distal edge of the first foot-bracing platform and the distal edge of the second foot-bracing platform;
- a sagittal plane being positioned in between the first foot-bracing platform and the second foot-bracing platform;
- the first foot-bracing platform being oriented at a first interior acute angle with the sagittal plane;
- the second foot-bracing platform being oriented at a second interior acute angle with the sagittal plane;
- the elongated balance block being positioned normal to the sagittal plane;
- the first textured laver being connected across the first foot-bracing platform, opposite the elongated balance block; and
- the elongated balance block extends beyond underside surfaces of the first and second foot-bracing platforms to provide contact surface with a ground.

2. The foot and ankle strengthening device as claimed in claim 1 comprises:
- a second textured layer; and
- the second textured layer being connected across the second foot-bracing platform, opposite the elongated balance block.

3. The foot and ankle strengthening device as claimed in claim 1 comprises:
- a plurality of grip-enhancing features; and
- the plurality of grip-enhancing features being laterally connected around the textured roller.

4. The foot and ankle strengthening device as claimed in claim 2, wherein each of the plurality of grip-enhancing features is configured into a hexagonal prism.

5. The foot and ankle strengthening device as claimed in claim 1 comprises:
- the textured roller comprises a thermally-conductive housing and a thermally-resistive core;
- the thermally-resistive core being mounted within the thermally-conductive housing; and
- the thermally-resistive core being in thermal communication with the thermally-conductive housing.

6. The foot and ankle strengthening device as claimed in claim 1 comprises:
- the elongated balance block comprises a first block end and a second block end;
- the first block end being positioned offset from the distal edge of the first foot-bracing platform; and
- the second block end being positioned offset from the distal edge of the second foot-bracing platform.

7. The foot and ankle strengthening device as claimed in claim 1 comprises:

a roller mount;

the roller mount being integrated in between the proximal edge of the first foot-bracing platform and the proximal edge of the second foot-bracing platform; and the textured roller being rotatably attached into the roller mount.

8. The foot and ankle strengthening device as claimed in claim 7 comprises:

the textured roller comprises a first mounting protrusion, a second mounting protrusion, and a roller body;

the first mounting protrusion being terminally connected to the roller body;

the second mounting protrusion being terminally connected to the roller body, opposite the first mounting protrusion; and the first mounting protrusion and the second mounting protrusion being rotatably engaged to the roller mount.

9. The foot and ankle strengthening device as claimed in claim 1, wherein the first interior acute angle is in a range between 70 arc degrees and 80 arc degrees.

10. The foot and ankle strengthening device as claimed in claim 1, wherein the second interior acute angle is in a range between 70 arc degrees and 80 arc degrees.

11. The foot and ankle strengthening device as claimed in claim 1 comprises:

the first foot-bracing platform and the second foot-bracing platform each comprises a platform body;

a width of the platform body being in a range between 6 inches to 12 inches; and a length of the platform body being in a range between 12 inches to 18 inches.

12. A foot and ankle strengthening device comprises:

a first foot-bracing platform;

a second foot-bracing platform;

a textured roller;

an elongated balance block;

a plurality of grip-enhancing features;

a roller mount;

a first textured layer;

a second textured layer;

the first foot-bracing platform and the second foot-bracing platform each comprise a proximal edge and a distal edge;

the proximal edge of the first foot-bracing platform and the proximal edge of the second foot-bracing platform being positioned adjacent to each other;

the textured roller being rotatably mounted between the proximal edge of the first foot-bracing platform and the proximal edge of the second foot-bracing platform;

the elongated balance block being mounted between the distal edge of the first foot-bracing platform and the distal edge of the second foot-bracing platform;

the elongated balance block being centrally positioned along the distal edge of the first foot-bracing platform and the distal edge of the second foot-bracing platform;

a sagittal plane being positioned in between the first foot-bracing platform and the second foot-bracing platform;

the first foot-bracing platform being oriented at a first interior acute angle with the sagittal plane;

the second foot-bracing platform being oriented at a second interior acute angle with the sagittal plane;

the elongated balance block being positioned normal to the sagittal plane and extends beyond underside surfaces of the first and second foot-bracing platforms to provide contact surface with a ground;

the first textured layer being connected across the first foot-bracing platform, opposite the elongated balance block;

the second textured layer being connected across the second foot-bracing platform, opposite the elongated balance block;

the plurality of grip-enhancing features being laterally connected around the textured roller;

the roller mount being integrated in between the proximal edge of the first foot-bracing platform and the proximal edge of the second foot-bracing platform; and the textured roller being rotatably attached into the roller mount.

13. The foot and ankle strengthening device as claimed in claim 12, wherein each of the plurality of grip-enhancing features is configured into a hexagonal prism.

14. The foot and ankle strengthening device as claimed in claim 12 comprises:

the textured roller comprises a thermally-conductive housing and a thermally-resistive core;

the thermally-resistive core being mounted within the thermally-conductive housing; and the thermally-resistive core being in thermal communication with the thermally-conductive housing.

15. The foot and ankle strengthening device as claimed in claim 12 comprises:

the elongated balance block comprises a first block end and a second block end;

the first block end being positioned offset from the distal edge of the first foot-bracing platform; and the second block end being positioned offset from the distal edge of the second foot-bracing platform.

16. The foot and ankle strengthening device as claimed in claim 12 comprises:

the textured roller comprises a first mounting protrusion, a second mounting protrusion, and a roller body;

the first mounting protrusion being terminally connected to the roller body;

the second mounting protrusion being terminally connected to the roller body, opposite the first mounting protrusion; and the first mounting protrusion and the second mounting protrusion being rotatably engaged to the roller mount.

17. The foot and ankle strengthening device as claimed in claim 12, wherein the first interior acute angle is in a range between 70 arc degrees and 80 arc degrees.

18. The foot and ankle strengthening device as claimed in claim 12, wherein the second interior acute angle is in a range between 70 arc degrees and 80 arc degrees.

19. The foot and ankle strengthening device as claimed in claim 12 comprises:

the first foot-bracing platform and the second foot-bracing platform each comprises a platform body;

a width of the platform body being in a range between 6 inches to 12 inches; and a length of the platform body being in a range between 12 inches to 18 inches.

* * * * *